US005497567A

United States Patent [19]

Gilbert

[11] Patent Number: 5,497,567

[45] Date of Patent: Mar. 12, 1996

[54] WIDE TRENCHER WITH PLURALITY OF CHAIN TYPE DIGGERS

[76] Inventor: Jerry F. Gilbert, 1400 E. Highway 26, Grapevine, Tex. 76051

[21] Appl. No.: 245,942

[22] Filed: May 19, 1994

[51] Int. Cl.[6] ..... E02F 5/00

[52] U.S. Cl. ..... 37/352; 299/76

[58] Field of Search ..... 37/352, 353, 354, 37/355, 356, 357, 358, 359, 360, 361, 362, 462, 463, 464; 172/100; 299/18, 64, 76, 80, 84

[56] References Cited

U.S. PATENT DOCUMENTS

| | | | |
|---|---|---|---|
| 1,317,607 | 10/1919 | French . | |
| 1,371,752 | 3/1921 | Funk . | |
| 1,377,333 | 5/1921 | French . | |
| 1,777,439 | 10/1930 | Lamont . | |
| 1,858,727 | 5/1932 | Bentson . | |
| 2,768,820 | 10/1956 | Russell | 299/76 |
| 2,806,683 | 9/1957 | Russell | 299/76 |
| 2,858,121 | 10/1957 | Russell | 299/76 |
| 3,050,295 | 8/1962 | Osgood | 299/76 |
| 3,116,914 | 11/1964 | Young et al. | 299/76 X |
| 3,319,364 | 5/1967 | Evans | 37/86 |
| 4,106,224 | 9/1978 | Cuevas | 37/80 A |
| 4,626,032 | 12/1986 | Harris et al. | 299/76 X |
| 4,775,001 | 7/1988 | Gilbert | 299/39 |
| 4,785,560 | 11/1988 | Hanson | 299/76 X |
| 5,212,895 | 5/1993 | Camilleri | 37/80 A |
| 5,228,220 | 7/1993 | Bryan, Jr. | 37/364 |

*Primary Examiner*—Eric K. Nicholson
*Assistant Examiner*—Robert Pezzuto
*Attorney, Agent, or Firm*—Marcus L. Bates

[57] ABSTRACT

An improved excavating machine for digging an unusually wide ditch having a boom that supports a plurality of chain type digging apparatus. There is a head shaft at one end of the boom and a tail shaft at the opposed end of the boom. An intermediate shaft is supported on the boom at a location between the tail and head shaft. Spaced endless digging chains are meshed with sprockets on the head shaft and selected ones of the tailwheel shaft sprockets to provide an upper run and a lower run of endless digging chain which forms an endless central digging and conveying member by which excavated material is translocated from the ground to a lateral conveyor on the machine. Spaced endless intermediate digging chains are meshed with the outermost of sprockets on the tail and intermediate shafts to form opposed, endless, outer digging and conveying members. The marginal far end of the boom is bifurcated to provide a longitudinally extending slot through which the intermediate drive chain for rotating the intermediate shaft extends. The intermediate shaft extends laterally through the boom and between the upper and lower runs of the central digging and conveying members, and increases the width of the ditch an amount equal to the combined width of the central and the opposed endless outer digging and conveying members.

20 Claims, 3 Drawing Sheets

WIDE TRENCHER WITH PLURALITY OF CHAIN TYPE DIGGERS

BACKGROUND OF THE INVENTION

The construction of ditches requires that a considerable amount of material be removed from the ground in order to provide an excavation which is at a specific elevation so that the ditch neither climbs nor descends abruptly. Construction of ditches and other excavations, such as road beds that are formed though mountains or closely adjacent to important structures often necessitates that the excavation be formed immediately adjacent to a sheer cliff, or adjacent to the vertical wall of a structure. My previous U.S. Pat. No. 4,755,001, discloses an excavating machine having a ladder type digging apparatus which includes digging apparatus attached to the sides thereof by which the width of an excavation or cut can be made wider than the throat of the excavating machine. This was achieved by the provision of opposed digging drums mounted for rotation on opposed ends of the tail shaft. The digging drums extended the width of the cut, however, the vertical dimension of the cut was equal to the diameter of the drum, and therefore unless several passes were made, the depth of the cut often was inadequate. Accordingly, a deep excavation was not practical with this digging machine without employment of additional earth moving apparatus.

The prior art U.S. Pat. No. 1,777,439 illustrates a ladder type digging boom having chain type side diggers associated therewith. The diggers are driven from the tail shaft so that a tight chain on the bottom of the side diggers was not possible with the prior art digging machine.

In the present invention, side digger chains are driven from an intermediate shaft located intermediate the head shaft and the tail shaft, thereby providing that the tight side of the side digger chain is located on the bottom of the boom, which is desirable because this location is where the digging is accomplished. Further, this arrangement enables all of the digging chains to be tensioned by sliding the boom out in the hood arrangement by which the boom is attached to the trencher main frame to thereby provide for the simultaneous tightening of all of the digging chains. Such a novel arrangement of a plurality of digging chains is not found in the prior art and provides unexpected and desirable results.

SUMMARY OF THE INVENTION

This specification sets forth the precise invention for which a patent is solicited, in such manner as to distinguish it From other inventions and from what is old. This invention comprises improvements in an excavating machine for digging an unusually wide excavation, or ditch, and comprises a main frame that supports a prime mover, and drive train for propelling the machine along the ground. The main frame supports an elongated digging apparatus that includes a boom and a plurality of chain type digging apparatus supported on the boom.

The boom has a near end opposed to a far end, with there being a head shaft at the near end of the boom, while a tail shaft is supported at the far end of the boom. Further, an intermediate shaft is supported on the boom at a location between the tail shaft and the head shaft.

There are a plurality of axially spaced sprockets mounted on the head shaft, a plurality of axially spaced sprockets mounted on the tail shaft, and a plurality of axially spaced sprockets mounted on the intermediate shaft. Means pivotally mount the boom near end to the trailing end of the main frame. Means connect the prime mover for rotating the sprockets located on the head shaft.

Further, spaced endless drive chains are meshed with the head shaft sprockets and selected ones of the tail shaft sprockets to thereby provide an upper run and a lower run of endless chain. Suitable earth removing implements, such as digging teeth, are mounted on and between the endless chains to form an endless central digging and conveying member by which excavated material is translocated from the ground to a remote location respective to the excavating machine.

The excavating machine further includes an intermediate drive for the intermediate shaft, which preferably is an endless drive chain that is meshed with a driven sprocket on the tail shaft and a driven sprocket located on the intermediate shaft is connected for rotating axially spaced sprockets of the intermediate shaft. Spaced endless intermediate chains are meshed with the outermost of idle sprockets located on the tail shaft and the outermost of the drive sprockets located on the intermediate shaft. Suitable earth removing implements, such as digging teeth, are also mounted on the endless intermediate chains to form opposed, endless, outer digging and conveying members.

The marginal far end of the boom is bifurcated to provide a longitudinally extending slot through which the intermediate drive chain for rotating the intermediate shaft extends to thereby rotate the sprockets supported on the intermediate shaft. The intermediate shaft extends laterally between the upper and lower runs of the spaced endless chains of the central digging and conveying members. This novel arrangement places the opposed endless outer digging and conveying members immediately adjacent to the opposed sides of the centrally located endless digging and conveying member, to thereby increase the width of the cut an amount equal to the combined width of the opposed endless outer digging and conveying members.

The opposed endless outer digging and conveying members remove material from the sides of the excavation concurrently being formed by the central digging member. The material removed by the outer digging and conveying members is translocated from a location intermediate the far and near ends of the endless central digging and conveying member, the latter of which conveys all of the removed material away from the excavation. The main frame includes means supported thereon for receiving material from the endless central digging and conveying member and for moving excavated material from proximity of the digging machine.

A primary object of the present invention is the provision of an excavating machine having an elongated pivoted digging apparatus that includes a plurality of endless chain type digging members for excavating material wherein the excavation is made wider than the throat of the digging machine.

Another object of the invention is the provision of an excavating machine having an elongated digging apparatus pivotally attached thereto, with there being a plurality of endless digging members included thereon which digs and conveys excavated material away therefrom, and wherein all of the endless digging members are arranged to simultaneously dig with the bottom run of the chain tensioned.

A further object of this invention is to disclose and provide an excavating machine having an elongated excavating apparatus pivotally mounted to the rear end thereof, wherein the excavating apparatus is comprised of a central digging member with opposed outer digging members being attached adjacent to and driven by the central digging member, and wherein the central digging member and opposed digging members are endless chains having digging teeth attached thereto for excavating and conveying the excavated material, and which are arranged to dig with the lower runs thereof tensioned.

Another and still further object of this invention is the provision of an excavating machine having a boom mounted elongated digging apparatus that includes a near end pivotally attached to the frame of the machine, and opposed outer digging members being attached adjacent to and driven by the central digging member, and a bifurcated tail end of the boom arranged to form a passageway through which drive means for the outer digging members extends.

An additional object of the present invention is the provision of an efficient, unusually wide digging machine having a main body which moves along the ground and supports an elongated digging apparatus from the trailing end thereof, with the elongated digging apparatus having a pivoted end connected to the main body and a combination digging implements in the form of a plurality of endless digging members which include opposed side digging members mounted adjacent to a central digging member, with all of the digging members having a tensioned lower run and arranged to excavate and transport material in a novel manner to a lateral conveyor.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described herein.

DETAILED DESCRIPTION OF THE PREFERRED EMBODIMENTS

Figure 2:
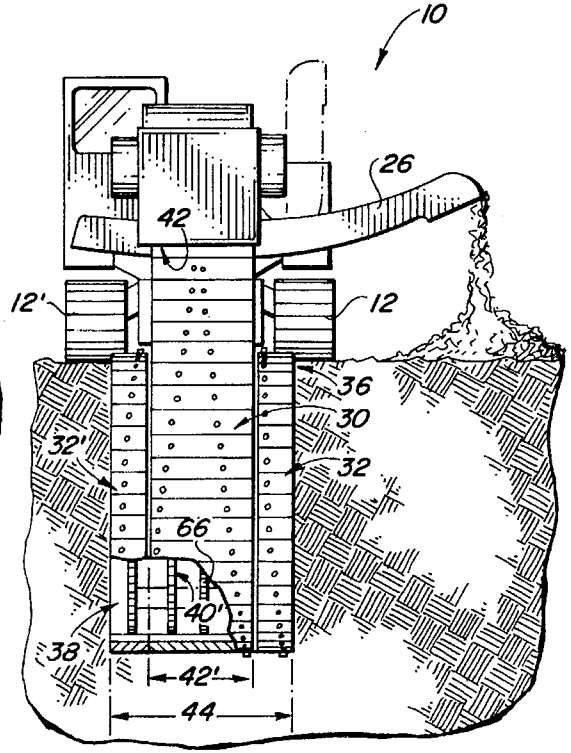
FIG. 2 is a rear view of the apparatus disclosed in FIG. 1.
Figure 1:
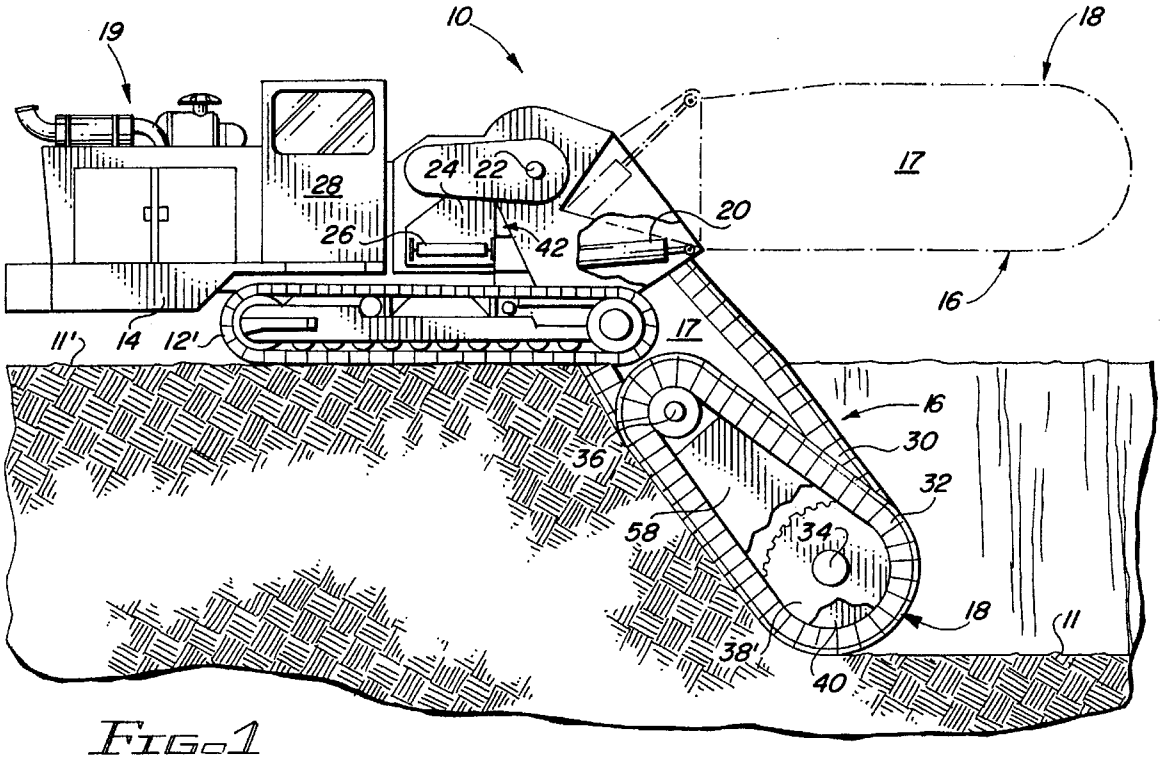
FIG. 1 is a part schematical, part diagrammatical, side view of a digging machine made in accordance with this invention.

The figures of the drawings illustrate various details of an excavating machine 10 for digging an unusually wide ditch 11 into the ground 11'. As seen in FIGS. 1 and 2, the excavating machine 10 is supported on a set of tracks 12, 12' and includes a main frame 14, 14'. A ladder type digging apparatus 16, made in accordance with this invention, includes a main support boom 17 therein which is attached to and extends from the trailing end of the main frame 14, 14'. Numeral 18 indicates the far end of the digging apparatus 16 while numeral 19 indicates a prime mover that preferably is located at the forward end of the main frame 14, 14' for propelling the excavating machine 10 along the ground 11'.

In FIG. 1, hydraulic cylinders 20 are connected between the main support boom 17 and the main frame 14, 14' to pivotally mount the digging apparatus 16 in a vertical plane. A head shaft 22 pivotally connects the near end of the main support boom 17 to the far or tail end of the main frame 14, 14' as shown in greater detail in my previous U.S. Pat. No. 4,755,001 which is incorporated herein for further details and background. The main frame 14, 14' has lateral opening 24 formed therein for accommodating a lateral conveyor 26 mounted thereto which extends though the openings 24 for translocating excavated material deposited thereon by the digging apparatus 16. An operator's cab 28 is mounted to the main frame 14, 14'.

In FIGS. 1 and 2, together with other figures of the drawings, the digging apparatus 16 includes a central digging member 30 and side digging members 32 and 32', all of which are suitably supported from boom 17. The digging apparatus 16 further includes a tail shaft 34 mounted at the tail end of boom 17, and an intermediate shaft 36 mounted along the length of boom 17 at a location that is intermediate the head wheel shaft 22 and tail shaft 34.

Figure 3:
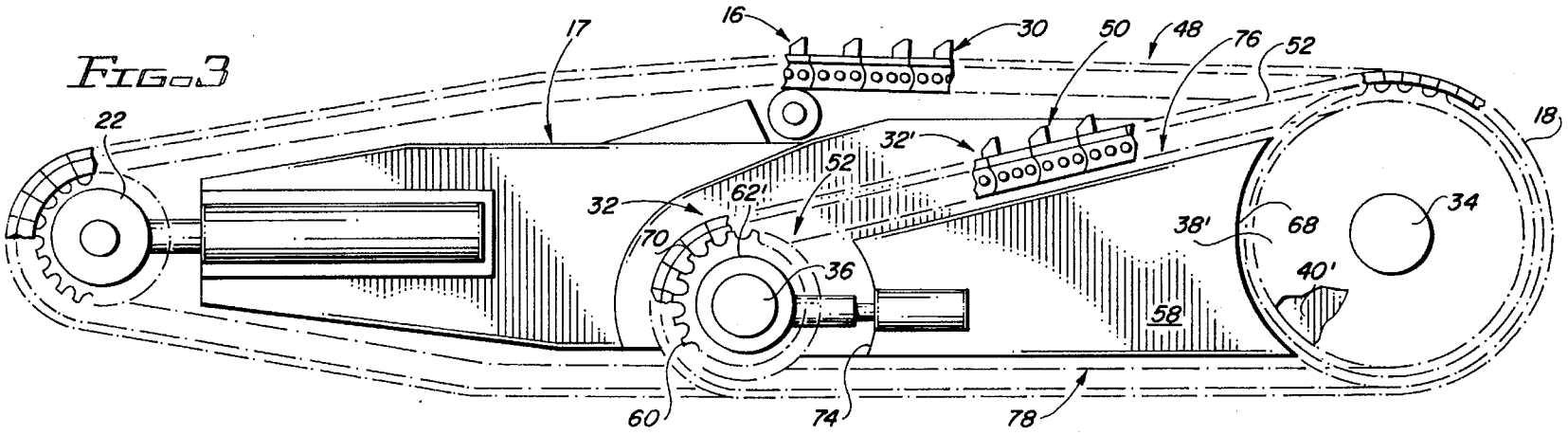
FIG. 3 is a part diagrammatical, part schematical, part cross-sectional, enlarged, side view which sets forth additional details of part of the apparatus disclosed in the foregoing figures.
Figure 7:
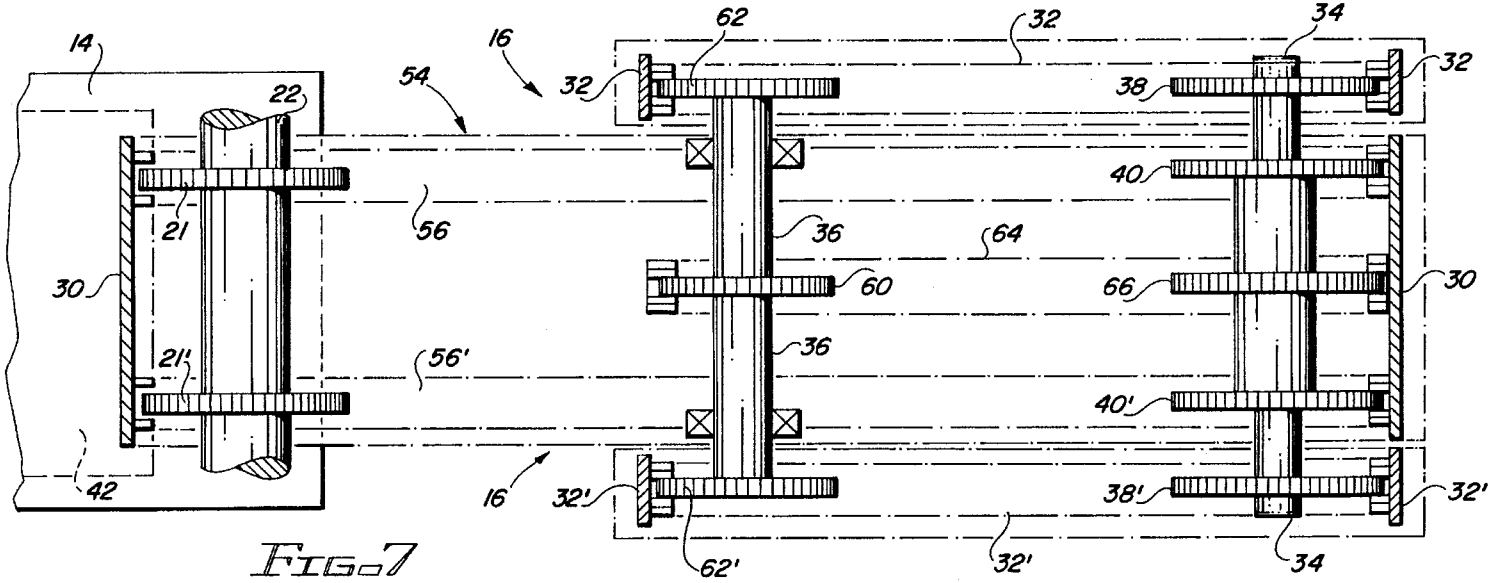
Figure 5:
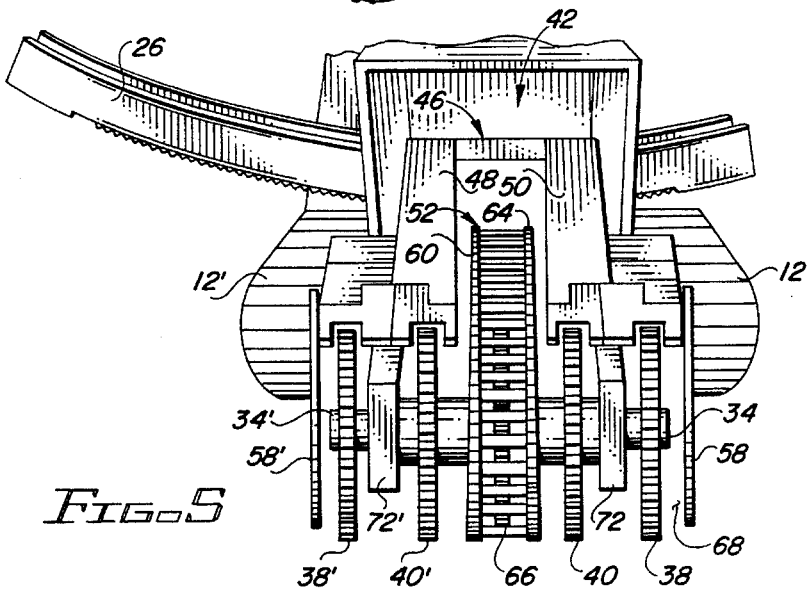
FIG. 5 is an enlarged end view of FIG. 1, with some parts thereof being removed therefrom so as to disclose some of the details of the underlying parts thereof.

As best illustrated in FIGS. 3, 5 and 7, an outer pair of opposed idle sprockets 38, 38' and an inner pair of opposed driven sprockets 40, 40' are mounted in axially spaced relation ship on the tail shaft 34. In FIG. 2, numeral 42' indicates the width of the central digging member 30 which is also the width of the throat 42 leading through the main frame and onto the conveyor 26 for receiving excavated material from the digging and conveying apparatus 16. Numeral 44 indicates the laterally extended digging width of the present invention and therefore includes the width of the side digging members 32, 32', together with the width of the central digging member 30.

Figure 6:
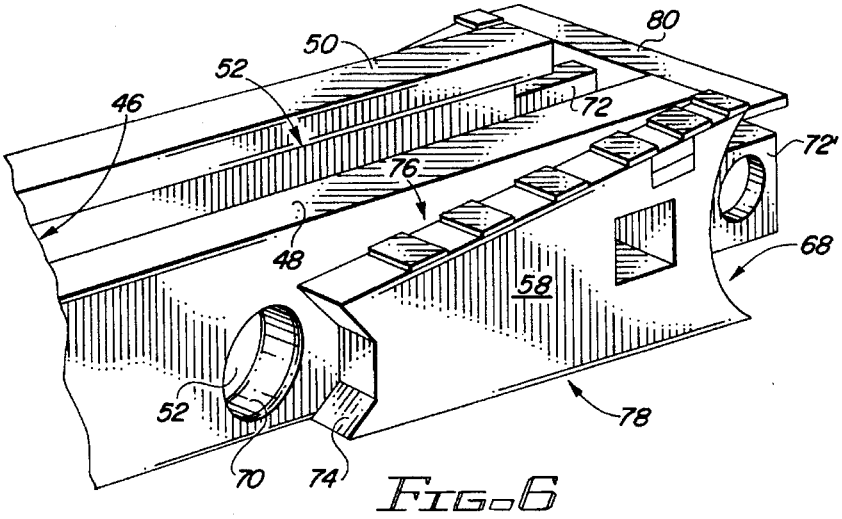
FIG. 6 is an enlarged, three-quarter, broken, side elevational view, with some parts being removed therefrom; and, FIG. 7 is an enlarged, fragmentary, part schematical, top plan view of part of the apparatus disclosed in FIGS. 1–3.

In FIGS. 3, 5 and 6, numeral 46 indicates a bifurcation of the tail end of boom 17 to provide spaced legs 48 and 50 between which a slot 52 extends. Slot 52 is equidistant the edges 54 of boom 17 ( FIG. 7). Side plates 58, 58' form part of the structure for supporting and rigidifing the bifurcated end of the boom 17. In FIG. 7, a driven intermediate center sprocket 60 of intermediate shaft 36 is arranged for driving outer opposed sprockets 62, 62' also supported on intermediate shaft 36.

The slot 52 accommodates an intermediate drive chain 64 which is meshed with the centrally located intermediate drive sprocket 60 and is driven by center tail sprocket 66 which is supported by the tail shaft 34. The center tail sprocket 66 is driven by the inner pair of opposed driven sprockets 40, 40' that are located on opposed sides of tail sprocket 66, while the centrally located inner pair of opposed sprockets 40, 40' are driven by endless main chains 56, 56' that are meshed with head shaft sprockets 21, 21' of the head shaft 22 and powered by a power train connected to the prime mover 19.

In FIGS. 5 and 6, numeral 68 indicates the curved mounting structure for accommodating the sprockets (38, 38', 40, 40', and 66) of the center and the side digging members (chains) 32, 32'. In FIGS. 6 and 7, transverse passageway 70 is arranged perpendicular respective to the slot 52 and accommodates the intermediate shaft 36 of FIG. 7 therewith. The center intermediate sprocket 60 is located at the intersection of the slot 52 and transverse passageway 70. Numeral 72 of FIG. 6 indicates a support for tail shaft 34 of FIG. 7. The outer sprockets 62, 62' of intermediate shaft 36 are positioned adjacent a curved member 74, while the upper and lower runs, respectively, of the side digger members 32, 32', extends along the illustrated upper and lower paths 76 and 78, respectively. The upper path 76 is laterally spaced from and parallel to the upper run of the intermediate drive chain 64 contained within slot 52, with the center digging chains 30 being located therebetween.

FIGS. 3, 4, 5 and 6 illustrate the details of boom 17 with the center digging member 30 supported thereon, and further discloses one of the side digging members 32, attached to the side of one leg of the pair of legs forming the marginal tail end of boom 17. The cooperative relationship between boom 17, center digging member 30, and the side digging members 32, 32' is best appreciated from studying FIG. 7 in conjunction with the remaining figures of the drawings.

Figure 4:
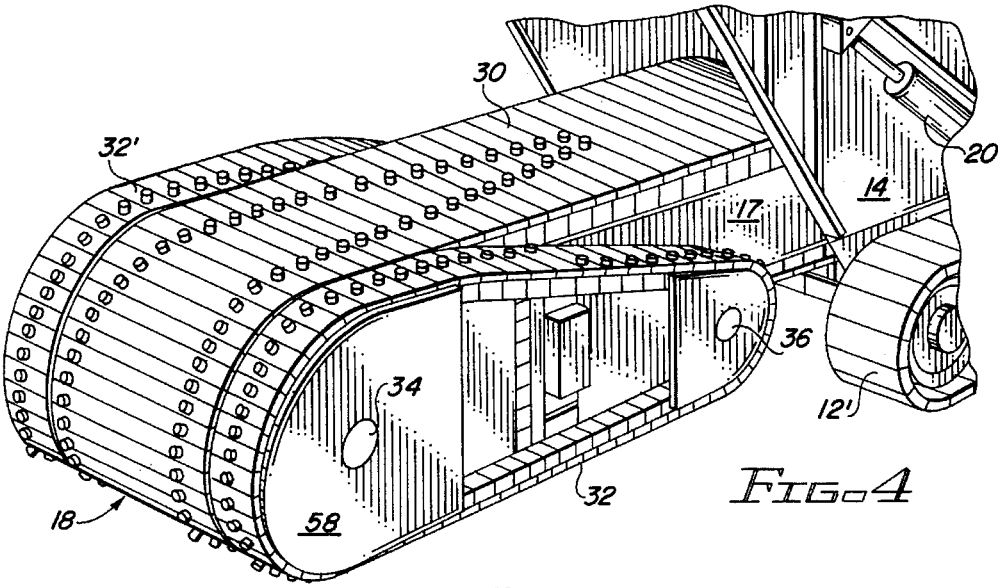
FIG. 4 is an enlarged, broken, three-quarter, rear perspective view of part of a digging machine seen in the foregoing figures and made in accordance with the present invention.

FIG. 4 illustrates the details of an actual reduction to practice and discloses many of the novel features of a digging apparatus made in accordance with this invention. FIG. 5 illustrates the apparatus of FIG. 4 wherein the center endless chains and the side endless chains have been removed therefrom in order to illustrate the arrangement of the bifurcated boom at 46, the resultant slot 52, and the arrangement of sprockets 38, 38', 40, 40', and 66. Note also the relationship of the center endless intermediate chain drive 64 extending from tail shaft center sprocket 66 into the boom slot 52.

FIG. 6 is a detailed illustration of the tail end of boom 17 in dissembled configuration, and showing boom legs 48, 50 and particularly the manner in which the center shaft 36 (FIG. 7), sprockets 60, 62, 62' (FIGS. 5 and 7), and side digging members 32, 32' (FIGS. 4 and 7) are accommodated by the bifurcated end 46 of boom 17.

In operation, the large diesel motor at 19 is connected to a power train to power the tracks 12, 12' as well as the head shaft sprockets 21, 21'. Reference is made to my previous U.S. Pat. No. 4,755,001 for further details of the drive train and the support of boom 17 as well as additional details, some of which may already be known to those skilled in the art of earth moving equipment. Rotation of head shaft sprockets 21, 21' moves the center endless main chains (56, 56') which support the digging teeth mounted on center digging member 30. The main chains (56, 56') move clockwise when viewed in FIG. 1 so that the lower run is engaging the ground and digging, therefore the lower run is under great tension while the upper run is slack. The lower run 78 of each side digging member 32, 32' is also under great tension, as will be appreciated by those skilled in the art of earth moving machines upon digesting all of the present disclosure.

Movement of the center digging member 30 rotates sprocket 66, noting that sprockets 40, 40', and 66 are all fastened to a common shaft made concentric with respect to tail shaft 34. Therefore opposed sprockets 40, 40', and 66 must all rotate concurrently, and this action also drives the intermediate chain 64 that is meshed with sprockets 60 and 66 to thereby drive the outer intermediate sprockets 62, 62' on shaft 36 which in turn drive the opposed side digging members 32, 32'. It should be noted that the chains of digging members 32, 32' are meshed with sprockets 62, 62' and idle sprockets 38, 38', and that sprockets 38, 38' are journeled to the shaft 34 and can rotate independently respective to the other sprockets supported on the shaft 34. FIGS. 3, 5, and 6 best illustrate the details of the slot and the manner in which the intermediate drive chain 64 extends therethrough.

I claim:

1. Excavating machine for digging a ditch comprising a main frame, and means including a prime mover and drive train for propelling said machine along the ground;

an elongated digging apparatus that includes a boom having a near end opposed to a tail end, a head shaft at the near end of said boom, a tail shaft at the tail end of the boom, means supporting an intermediate shaft on said boom between said tail shaft and said head shaft;

a plurality of axially spaced sprockets on said head shaft, a plurality of axially spaced sprockets on said tail shaft including innermost and outermost sprockets, a plurality of axially spaced sprockets on said intermediate shaft including innermost and outermost sprockets, means pivotally mounting said boom near end to said main frame;

spaced, parallel, endless chains meshed with said sprockets on said head shaft and with the innermost sprockets on said tail shaft to thereby provide an upper chain run and a lower chain run; digging means for excavating the ground supported by said endless chains forming an endless central digging and conveying member;

means connecting said prime mover for rotating said sprockets on said head shaft and thereby move said endless chains meshed with said sprockets on said head shaft;

an intermediate endless chain meshed with an innermost sprocket on said tail shaft and meshed with an innermost sprocket on said intermediate shaft for rotating said axially spaced sprockets on said intermediate shaft;

spaced endless chains meshed with the outermost sprockets on said tail shaft and with the outermost sprockets on said intermediate shaft to thereby form opposed intermediate outer endless chains; digging means for excavating the ground supported by said opposed intermediate outer endless chains which form opposed endless outer digging and conveying members; and, conveyor means for receiving excavated material from the endless central digging and conveying member, and from the opposed endless outer digging and conveying members and moving any excavated material from proximity of the digging machine.

2. The excavating machine of claim 1 wherein said intermediate shaft extends laterally respective to said boom and in parallel relationship respective to said tail and head shaft;

said tail shaft sprockets include a central sprocket mounted thereon for driving said sprockets on said intermediate shaft, which in turn drives said intermediate outer endless chain.

3. The excavating machine of claim 1 wherein said end of said boom is bifurcated to provide a longitudinally extending slot through which said intermediate chain extends to said intermediate shaft.

4. The excavating machine of claim 1 wherein said intermediate shaft extends laterally between the upper and lower runs of the spaced endless chains connected about said sprockets on said head shaft and said tail shaft;

means by which said outermost of said sprockets on said tail shaft are journeled to rotate independently of the remaining sprockets on said tail shaft.

5. The excavating machine of claim 1 wherein said means pivotally mounting said boom near end to said main frame includes means journaling said head shaft at the near end of said boom for pivotal movement of the boom in a vertical plane; and, means connecting said prime mover to rotate the sprockets associated with the head shaft and thereby move the endless chains that support the central digging and conveying member.

6. The excavating machine of claim 1 wherein said intermediate shaft extends laterally between the upper and lower runs of the spaced endless chains meshed with said sprockets on said head shaft and said tail shaft;

said means pivotally mounting said boom near end to said main frame includes means journaling said head shaft at the near end of said boom for pivotal movement of the boom vertically, and means connecting said prime mover to rotate the sprockets associated with the head shaft and thereby move the chains interconnecting said head and tail shafts.

7. A digging machine for excavating material from the ground comprising a main frame having a prime mover and drive train connected for moving said machine along the ground;

an elongated boom having a near end and a far end; a head shaft at the near end of said boom by which a near end of said boom is attached to said main frame for pivotal movement in a vertical plane, a tail shaft at the far end of said boom, an intermediate shaft supported on said boom between said tail shaft and said head shaft; said head, tail, and intermediate shafts are parallel and spaced from one another;

a plurality of axially spaced sprockets supported on said head shaft, a plurality of axially spaced sprockets supported on said tail shaft, a plurality of axially spaced sprockets supported on said intermediate shaft, spaced endless chains connected about said sprockets on said head shaft and selected ones of said sprockets supported on said tail shaft; means supported by said endless chains which form an endless central digging and conveying member;

an endless drive chain connected about a sprocket on said tail shaft and about a sprocket on said intermediate shaft for driving said axially spaced sprockets on said intermediate shaft;

spaced endless intermediate chains connected about opposed said sprockets on said tail shaft and about opposed said sprockets on said intermediate shaft; means supported by said endless intermediate chains which form an endless outer digging and conveying member;

means for receiving excavated material from the endless central digging and conveying member and moving the excavated material from proximity of the digging machine.

8. The digging machine of claim 7 wherein said intermediate shaft extends laterally respective to said boom and in parallel relationship respective to said tail and head shafts;

said tail shaft sprockets include a central sprocket affixed thereto for driving one of said sprockets on said intermediate shaft, which in turn drives said intermediate chains.

9. The digging machine of claim 8 wherein said far end of said boom is bifurcated to provide a longitudinally extending slot through which said intermediate chain extends from said tail shaft to said intermediate shaft;

said means for receiving material from the endless central digging and conveying member and moving any excavated material from proximity of the digging machine is a laterally arranged conveyor arranged in underlying relationship respective to said head shaft.

10. The digging machine of claim 9 wherein said intermediate shaft extends laterally between the upper and lower runs of the spaced endless chains connected about said sprockets on said head shaft and said tail shaft;

said outer digging and conveying members mounted on said intermediate chains extend the effective lateral digging width of said digging machine.

11. The digging machine of claim 7 wherein said means pivotally mounting said boom near end to said main frame includes means journaling said head shaft at the near end of said boom for pivotal movement of the boom in a vertical plane, and means connecting said prime mover to rotate the sprockets associated with the head shaft and thereby move the endless chains.

12. The digging machine of claim 7 wherein said intermediate shaft extends laterally between the upper and lower runs of the spaced endless chains connected about said sprockets associated with said head shaft and said tail shaft;

said means pivotally mounting said boom near end to said main frame includes means journaling said head shaft at the near end of said boom for pivotal movement of the boom vertically; and, means connecting said prime mover to rotate the sprockets associated with the head shaft and thereby move the endless chains interconnecting said head and tail shafts.

13. A ground supported excavating machine for making an excavation into the earth, comprising:

a main frame having a prime mover and drive train for moving said machine along the ground; a digging apparatus that includes an elongated boom having a head shaft mounted at one end of said boom and a tail shaft mounted at the opposed end of the boom;

said one end of said boom is attached to said main frame and said opposed end depends therefrom; an intermediate shaft supported on said boom between said tail shaft and said head shaft; a plurality of axially spaced sprockets supported on said head shaft, a plurality of axially spaced sprockets supported on said tail shaft, a plurality of axially spaced sprockets supported on said intermediate shaft, the sprockets mounted on said tail shaft include opposed idle sprockets with there being other sprockets located therebetween;

spaced endless chains meshed with said axially spaced sprockets supported on said head shaft and meshed with said other sprockets that are supported on said tail shaft; digging means supported by said endless chains which form an endless central digging and conveying member;

an endless intermediate drive chain meshed with at least one of said other sprockets that are supported on said tail shaft and meshed with at least one of said axially spaced sprockets supported on said intermediate shaft for driving the remaining said axially spaced sprockets supported on said intermediate shaft;

spaced endless chains meshed with said idle sprockets on said tail shaft and meshed with said remaining said sprockets supported on said intermediate shaft; means supported by the last said spaced endless chains which form an endless outer digging and conveying member;

conveying means including a throat in said main frame for receiving material from the endless central digging and conveying member, and for conveying excavated material from proximity of the digging machine;

said outer digging and conveying members enable an excavation to be formed which is substantially wider than said throat.

14. The excavating machine of claim 13 wherein said intermediate shaft extends laterally respective to said boom and in parallel relationship respective to said tail and head shaft;

said tail shaft sprockets include a central sprocket affixed thereto for driving one of said sprockets on said intermediate shaft, which in turn drives said intermediate chains.

15. The excavating machine of claim 13 wherein said far end of said boom is bifurcated to provide a longitudinally extending slot through which said intermediate drive chain extends from said tail shaft to said intermediate shaft;

said means for receiving material from the endless central digging and conveying member and moving any excavated material from proximity of the digging machine is a laterally arranged conveyor arranged in underlying relationship respective to said head shaft.

16. The excavating machine of claim 15 wherein said intermediate shaft extends laterally between the upper and lower runs of the spaced endless chains connected about said sprockets on said head shaft and said tail shaft;

said outer digging and conveying members mounted on said intermediate chains extend the effective lateral digging width of said digging machine.

17. The excavating machine of claim 13 wherein said means pivotally mounting said boom near end to said main frame includes means journaling said head shaft at the near end of said boom for pivotal movement of the boom vertically, and means connecting said prime mover to rotate the sprockets associated with the head shaft and thereby move the chains.

18. The excavating machine of claim 13 wherein said intermediate shaft extends laterally between the upper and lower runs of the spaced endless chains connected about said sprockets on said head shaft and said tail shaft;

said means pivotally mounting said boom near end to said main frame includes means journaling said head shaft at the near end of said boom for pivotal movement of the boom vertically, and means connecting said prime mover to rotate the sprockets associated with the head shaft and thereby move the chains.

19. The digging machine of claim 18 wherein said far end of said boom is bifurcated to provide a longitudinally extending slot through which said intermediate chain extends from said tail shaft to said intermediate shaft;

said means for receiving material from the endless central digging and conveying member and moving any excavated material from proximity of the digging machine is a laterally arranged conveyor arranged in underlying relationship respective to said head shaft.

20. The excavating machine of claim 19 wherein said intermediate shaft extends laterally respective to said boom and in parallel relationship respective to said tail and head shafts; and, said tail shaft sprockets include a central sprocket affixed thereto for driving one of said sprockets on said intermediate shaft, which in turn drives said intermediate chains.

* * * * *